United States Patent [19]

Haltmeier

[11] Patent Number: 4,770,910

[45] Date of Patent: Sep. 13, 1988

[54] PROCESS FOR IMPREGNATING WOOD

[76] Inventor: Georg Haltmeier, Preindlgasse 2, A-1130 Vienna, Austria

[21] Appl. No.: 2,925

[22] Filed: Jan. 13, 1987

[30] Foreign Application Priority Data

Jan. 20, 1986 [AT] Austria ..... 123/86

[51] Int. Cl.[4] ..... B05D 1/18

[52] U.S. Cl. ..... 427/440; 428/541

[58] Field of Search ..... 427/440; 428/541

[56] References Cited

U.S. PATENT DOCUMENTS

| | | | |
|---|---|---|---|
| 4,337,720 | 7/1982 | Hager | 427/440 X |
| 4,591,515 | 5/1986 | Dickinson et al. | 427/440 X |
| 4,637,952 | 1/1987 | Rosenlund | 427/440 X |

FOREIGN PATENT DOCUMENTS

| | | |
|---|---|---|
| 145521 | 5/1936 | Austria . |
| 176354 | 10/1953 | Austria . |
| 255111 | 6/1967 | Austria . |
| 352992 | 10/1979 | Austria . |
| 352993 | 10/1979 | Austria . |
| 902787 | 12/1953 | Fed. Rep. of Germany . |
| 940376 | 2/1956 | Fed. Rep. of Germany . |
| 943854 | 5/1956 | Fed. Rep. of Germany . |
| 967394 | 10/1957 | Fed. Rep. of Germany . |

*Primary Examiner*—Michael R. Lusignan

*Attorney, Agent, or Firm*—Young & Thompson

[57] ABSTRACT

In a process for the impregnation of wood, first a treatment is performed by inoculating impregnation with pasty impregnating salt or the like, introduced by injection needles, and immediately following, a tank impregnation is conducted with the use of a liquid impregnating agent.

3 Claims, No Drawings

PROCESS FOR IMPREGNATING WOOD

The invention relates to a process for the impregnation of wood, such as wooden poles, round timbers, mining timber, and the like, wherein an inoculating impregnation is performed with, in particular, paste-like impregnating salt or the like, and a treating cylinder impregnation is conducted with the use of a liquid impregnating agent, for example an aqueous solution of a preservative salt.

Treating cylinder impregnation has been known from German Pat. No. 902,787, German Pat. No. 967,394, and Austrian Pat. No. 352,992 wherein the wood to be impregnated is saturated with aqueous salt solutions in a treating cylinder which can optionally be placed alternatingly under excess pressure and under vacuum. This treating cylinder impregnation is utilized for impregnating wooden poles, railroad ties, mine timber, or the like for the purpose of preservation.

Besides this treating cylinder impregnation with the use of salt solutions, creosote oil, and the like, conducted for the purpose of preservation, reducing flammability and water absorption ability of wood, it is necessary especially in case of wood poles to additionally preserve the installation zone. This additional preservation takes place by driving inoculating needles into the wood and injecting through the driven-in injection needles particularly pasty impregnating salt or the like into the wood. Devices for performing this inoculating impregnation are known from Austrian Pat. No. 176,354, German Pat. Nos. 940,376 and 943,854, as well as from Austrian Pat. Nos. 255,111 and 352,993.

Heretofore, tank impregnation has been conducted first of all in the predominant number of cases in the combined impregnation wherein wood is treated for preservation by means of tank impregnation as well as inoculating impregnation.

Disadvantages in the conventional sequence of impregnating measures (first tank impregnation, then inoculating impregnation) reside, inter alia, in that in certain circumstances the surface area of the wood must be enlarged for the tank impregnation in order to attain within tolerable time periods an adequate saturation of the wood with the liquid impregnating agent. This surface enlargement is customarily achieved by routing grooves into the wood surface and by perforating the wood with the aid of drills (diameter about 3 mm). A further drawback of the conventional impregnating method resides in that wood already saturated with liquid impregnating medium must be subjected to the inoculating impregnation, for which purpose special protective steps must be taken to protect the personnel from excess contamination and injury to health on account of the impregnating salt.

Austrian Pat. No. 145,521 discloses a method for wood impregnation wherein initially an inoculating impregnation is conducted and subsequently thereto, as the most essential and indispensable part of the process, the inoculated wood is steamed with steam in a sealed boiler in order to distribute the impregnating agent, introduced by inoculating impregnation, within the wood. Austrian Pat. No. 145,521 contains only in a supplementary fashion the additional suggestion to effect, after steaming, furthermore a pressure impregnation with a solution of a preservative salt (solution of sodium fluoride). The mode of operation described in Austrian Pat. No. 45,521 is disadvantageous insofar as a time-consuming steaming requiring a large amount of energy, is performed. Moreover, an extraordinarily large quantity of impregnating medium is needed in the conventional mode of operation, which is not only expensive but also deleterious with a view toward minimum pollution of the environment. Furthermore, the steaming between the impregnating stages as proposed in Austrian Pat. No. 145,521 has the additional drawback that the wood, first dried with great effort, is again moistened which greatly impedes the subsequent tank impregnation.

The invention is based on the object of providing an impregnating method of the type discussed hereinabove which does no display the above-mentioned disadvantages, which is economical, which can be performed in a simple and rapid fashion, and which consumes less impregnating medium than the conventional processes.

In attaining this object, the invention provides that the tank impregnation with the liquid impregnating agent is conducted immediately after the treatment by inoculating impregnation with the, in particular, pasty impregnating salt or the like.

Surprisingly, it has been found that the liquid impregnating agent, introduced by the tank impregnation, penetrates even into the zones of the wood to be preserved wherein the impregnating salt, pasty, for example, that has been previously introduced by the inoculating impregnation, is present. Moreover, the process of this invention affords the not inconsiderable advantage that clean timbers can be worked during the inoculating impregnation. Finally, another considerable advantage of the process of this invention resides in that it is no longer necessary to enlarge the surface area of the wood to be impregnated by perforating and routing of grooves prior to the tank impregnation, since the holes created during the inoculating impregnation by the insertion of the inoculating needles result in an adequate surface enlargement. Inasmuch as the wood fibers during penetration of the inoculating needles, are not cut apart, as contrasted to the drilling or routing treatment, but rather are merely urged toward the side, the use of the process according to this invention results in impregnated wooden parts which exhibit an essentially smooth and clean surface. This is so because the fibers on the surface of the wood will temporarily swell while tank impregnation is performed, extensively resuming their original position and thus sealing the introduced impregnating medium depots.

The circumstance that in the process of this invention a tank impregnation is performed immediately after the inoculating impregnation, i.e. without any intermediate treatment of the wood, not only saves the energy required for steaming in steam, but also reduces the quantity of impregnating medium required to a considerable extent without reducing the preservative effect.

In contrast to the method described in Austrian Pat. No. 145,521, the process of this invention, therefore, quite intentionally eliminates the steaming step. Thereby, there is no immediate distribution of the impregnating salt, either, as has been considered an essential feature in the conventional process. Consequently, besides saving energy and impregnating medium, another result thus obtained is the effect, favorable for long-term protection of the wood, of a gradual distribution—taking up to several years—of the impregnating agent within the wood. This is surprising inasmuch as a person skilled in the art derives the teaching from Austrian Pat. No. 145,521 that only a rapid distribution (effected by steaming) of the impregnating salt introduced during inoculating impregnation will result in an effective wood preservation.

In order to perform the inoculating impregnation and the subsequent tank impregnation, it is possible to utilize, for example, the operating means known from the above-mentioned references, in particular the device known from Austrian Pat. No. 352,993 for the inoculating impregnation and the tank impregnating installation known from Austrian Pat. No. 353,992.

One example of the process of this invention will be described below:

Peeled poles of pinewood dried up to impregnating readiness, having a diameter of 25 cm and a length of 10 m were impregnated by means of the device described in Austrian Pat. No. 352,993 with an impregnating agent (wood preservative in paste form) suitable for the inoculating injection method. The incision points of the needles were distributed in checkerboard fashion over the surface of the wooden poles and had a mutual spacing of 6 cm. Per inoculating step and per injection hole, about 2–3 g of wood preservative was injected.

The poles, thus pretreated by inoculating impregnation, were introduced, for tank impregnation, into an impregnating tank (vacuum impregnating tank) containing an aqueous solution of a preservative salt. The poles were left in the impregnating tank until an adequate absorption of preservative had taken place This took, depending on the process conditions utilized, 4–6 hours up to one day. As customary in tank impregnation, the point in time at which the wood to be preserved had absorbed an adequate amount of preservative was determined by observing the liquid level in the impregnating tank.

The thus-impregnated poles, for testing the absorption of preservative, were divided by cross cuts and longitudinal cuts and were examined optically for complete saturation and/or impregnation. In this connection, it was found that the preservative introduced by the tank impregnation (aqueous impregnating salt had also been absorbed in the zones into which previously the pasty preservative had been introduced by means of inoculating impregnation.

It was furthermore determined that the incision holes present after the inoculating impregnation had for the greatest part been closed up and the wooden poles exhibited a smooth surface.

On account of the special combination of the process steps in accordance with this invention, an economical impregnation has been made possible, requiring much lesser amounts of impregnating medium without resulting in a reduced decay resistance of the thus-treated timbers.

I claim:

1. Process for the impregnation of wood, such as wooden poles, round timbers, mining timber, and the like, comprising performing an inoculation impregnation of said wood by inserting inoculation means into the wood and injecting a pasty impregnating salt through said inoculation means and into the wood, and immediately thereafter conducting on the inoculation impregnated wood a tank impregnation by immersing the wood in a liquid impregnating agent in a tank.

2. A process as claimed in claim 1, in which said liquid impregnating agent is an aqueous solution of a preservative salt.

3. A process as claimed in claim 1, in which said inoculation impregnation is conducted by inserting inoculating needles into the wood thereby to deflect without cutting apart fibers of the wood.

* * * * *